United States Patent [19]

Fuse et al.

[11] 4,113,216

[45] Sep. 12, 1978

[54] APPARATUS FOR HANGING A BOARD

[75] Inventors: Takeshi Fuse, Kamakura; Toshio Yajima, Yokohama; Isao Hino, Amagasaki; Shohei Oka, Minoo, all of Japan

[73] Assignee: Osaka Prefectural Office, Osaka, Japan

[21] Appl. No.: 761,278

[22] Filed: Jan. 21, 1977

[30] Foreign Application Priority Data

Jan. 23, 1976 [JP] Japan ..... 51-006864

[51] Int. Cl.[2] ..... A47B 96/06

[52] U.S. Cl. ..... 248/204; 248/291; 40/602; 40/617

[58] Field of Search ..... 248/204, 291, 292, 289, 248/286; 49/386, 236, 239; 40/128, 138, 125 H; 273/181 J

[56] References Cited

U.S. PATENT DOCUMENTS

| | | | |
|---|---|---|---|
| 1,753,506 | 4/1930 | Florine | 49/239 |
| 1,910,666 | 5/1933 | Babson | 49/239 |
| 2,030,379 | 2/1936 | Lippold | 40/128 |
| 2,304,743 | 12/1942 | Schott | 40/128 |
| 3,263,365 | 8/1966 | Eckel | 49/386 |
| 3,695,610 | 10/1972 | Thompson | 273/181 J |

FOREIGN PATENT DOCUMENTS 1,117,545 5/1956 France.

*Primary Examiner*—Robert A. Hafer
*Attorney, Agent, or Firm*—Fleit & Jacobson

[57] ABSTRACT

Apparatus for hanging a board, such as a road sign board or an advertising sign board, comprises a first cam sleeve which is provided rotatably surrounding the axis of a construction for hanging a board and a second cam sleeve which is provided not rotatably but slidably on the same axis of the first cam sleeve. A board is fixed on the first cam sleeve and the one edge face of the second sleeve is pressed against the edge face of the first cam sleeve by the spring arranged at the other side of the second cam sleeve. Each contacting cam faces of the first and second cam sleeves has two sections which are vertical and slanting to the axis of the cam sleeve.

3 Claims, 10 Drawing Figures

APPARATUS FOR HANGING A BOARD

DETAILED DESCRIPTION

The invention is concerned with an apparatus for hanging a board, particularly for hanging a road sign board, advertising sign board and other sign board outdoors.

The prior art to which the invention is directed includes the art shown in FIGS. 1 and 2. As shown in these FIGS., the apparatus for hanging a board consists of a sign board 1 fixed to a hanging plate 2 which is fixed to a connecting plate 4 by a plural of bolt and an upper hanging plate 6 which is fixed to the horizontal part of a support pole 5 is connected with the connecting plate 4 by a bolt 7 and a shear pin 8. The sign board 1 therefore retains vertical position thereof and does not sway when the rotational stress around the bolt 7 by weak wind does not exceed the force of breakage of the shear pin 8. The shear pin 8 is broken however when the pressure of wind on the sign board increases and exceeds the force of breakage of the shear pin 8. The damage of other members of the apparatus is avoided by this action of the shear pin 8. After the breakage of the shear pin, the sign board sways by the slight pressure of wind and decrease the notice effect of a sign board and therefore it is necessary to change the broken shear pin and it causes much expense for labor mobilization.

The object of the invention is to provide an improved apparatus for hanging a board which can prevent the rotational movement of a sign board in the range of a certain anticipative pressure of wind and prevent the damage of the members of the apparatus by the free rotation of the sign board when the pressure of the wind is strong and restore automatically a stationary and vertical state when wind becomes slow down below a certain anticipative pressure.

Other object and aspects of the invention will become apparent from the following description of embodiment with reference to the accompanying drawings in which:

FIG. 7(*b*) is a graph showing the relation between the power of resistance and wind pressure according to the invention.

FIG. 8(*b*) is a graph showing the relation between the power of resistance and wind pressure according to the conventional apparatus for hanging a board.

Figure 3:
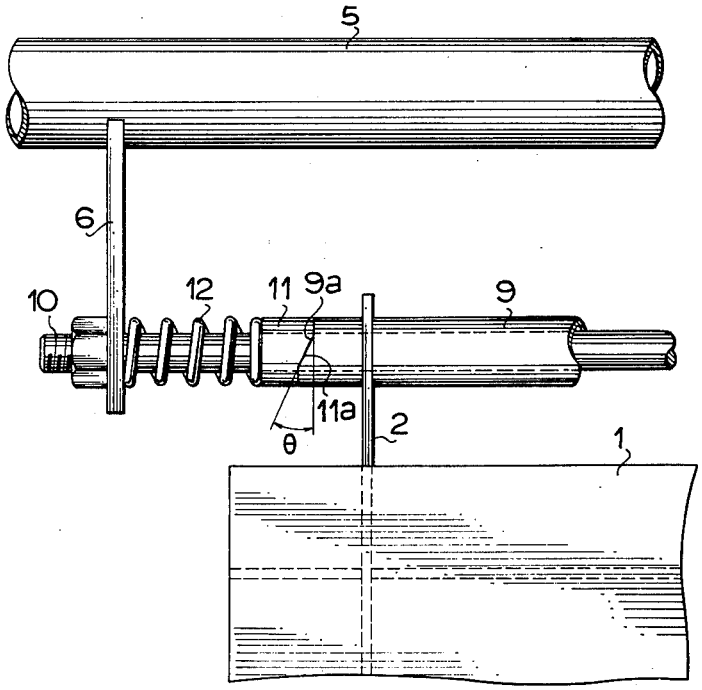
FIG. 3 is an enlarged elevational view of a main part of a preferred embodiment of the invention.

In FIG. 3, a sign board 1 is fixed to a hanging plate 2 which is fixed to a first cam sleeve 9. The first cam sleeve 9 is provided rotatably surrounding an axis 10 and a second cam sleeve 11 is provided not rotatably but slidably surrounding the axis 10. Both sides of the axis are fixed to an upper hanging plate 6 which is hung on a pole 5 and a spring 12 is arranged between the lower side of the upper hanging plate 6 and the second cam sleeve 11.

Cam faces 9*a* and 11*a* are formed at the opposing end faces of the first and the second cam sleeves and are contacted each other by the pressure of the spring 12.

The cam faces 9*a* and 11*a* of the cam sleeves 9 and 11 respectively have lower faces 9*b* and 11*b*, higher faces 9*c* and 11*c* and slant faces 9*d* and 11*d*, and hold the sign board 1 vertical as to the pole 5 by contacting the lower face 9*b* to the higher face 11*c* and the lower face 11*b* to the higher face 9*c*.

The first cam sleeve 9 receives moment of force around the axis 10 through the hanging plate 2 when the sign board 1 is subjected to the pressure of wind stronger than anticipated.

Such a moment force exceeds the frictional force between the cam surfaces 9*a* and 11*a* and the slant face 9*d* slides on the slant face 11*d* against frictional force and then the cam sleeve 9 rotates around the axis 10.

Figure 4:
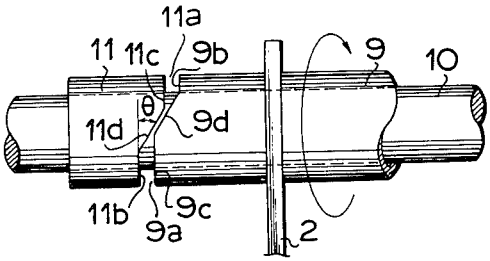
FIG. 4 is an enlarged elevational view of the main part of the embodiment of FIG. 3 receiving the pressure of a little bit higher than anticipated.

In such a case, the cam sleeve 11 slides a distance 1 ($=\gamma\alpha \times \sin\theta$) axially against the spring 10 and compresses the latter as shown in FIG. 4, when $\theta$ is the angle between the slant face 11*d* and the direction of a rotational force, $\alpha$ and $\gamma$ are the angle of rotation and the radius of the cam sleeve 9 respectively. Thereforethe pressure of the spring 12 against the cam face 11*a* is increased and suppresses the rotation of the sign board 1 caused by the wind pressure. The sign board 1 returns automatically to the vertical position by its own weight when wind slows down.

Figure 5:
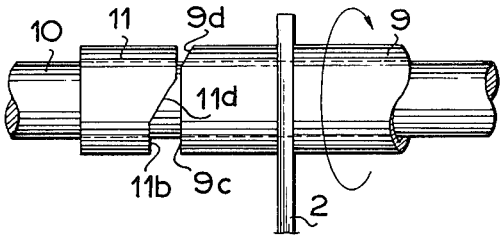
FIG. 5 is an enlarged elevational view of the main part of FIG. 3 receiving stronger pressure of wind than anticipated.

When the sign board 1 receives further strong wind pressure, the slant face 9*d* passes over the slant face 11*d* and the higher faces 9*c* and 11*c* contact each other as shown in FIG. 5. In this state, the sign board 1 can rotate freely and it is a similar state when the shear pin of a conventional apparatus for hanging a board is broken. In thsi case, the elastic force of the spring 12 against the end face 9*a* is strongest but only the force of sliding friction between the higher faces 9*c* and 11*c* parallel to the rotational direction of the cam sleeve 9 acts against the pressure of wind.

The sign board 1 returns automatically to the original vertical position by moment of force around the axis 10 caused by the weight of the sign board itself and by the restoring force of the spring 12.

When the pressure of wind is weaker than anticipated and moment of force acting on the sign board 1 is so small that the slant face 9*d* does not slide on the slant face 11*d* against the pressure of the spring 12, the sign board 1 retains vertical position thereof.

Figure 7:
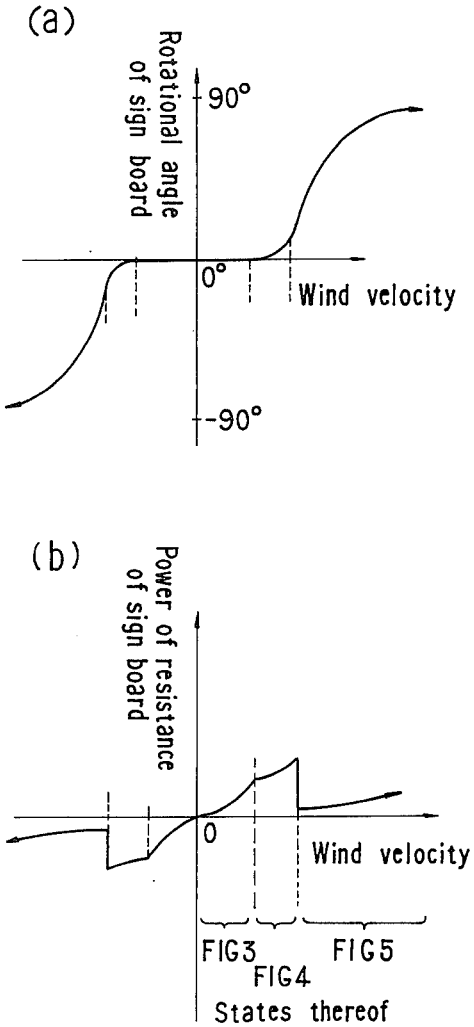
FIG. 7(*a*) is a graph showing the relation between the rotational angle of the sign board and wind pressure according to the invention.

The relation between the angle of rotation and the power of resistance of the sign board 1 of this invention is shown in FIG. 7*a* and 7*b*.

Figure 1:
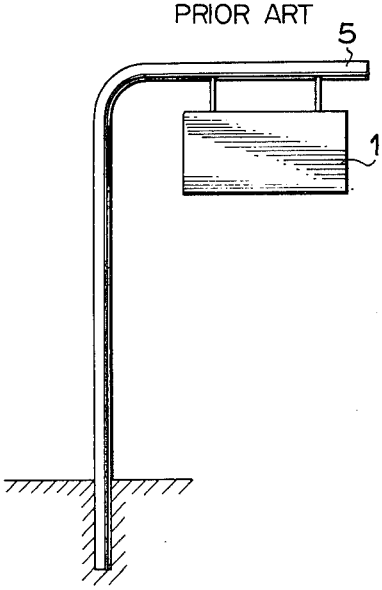
FIG 1 PRIOR ART
FIG. 1 is an elevational view which shows general concept of hanging state of a road sign board.
Figure 2:
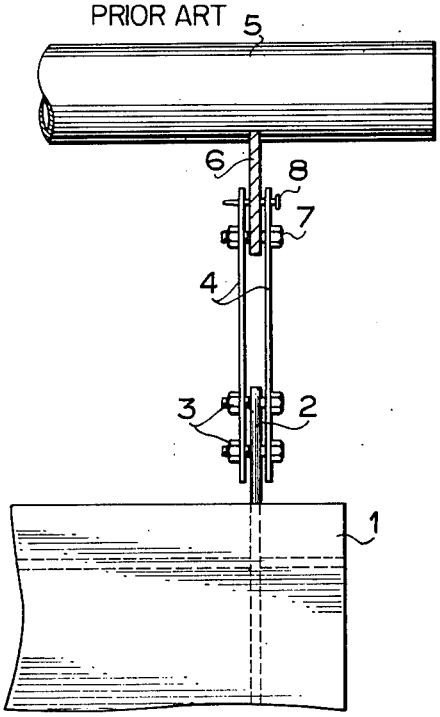
FIG 2 PRIOR ART
FIG. 2 is an enlarged elevational view of a conventional structure of an apparatus for hanging a board for the comparison with that of the invention.
Figure 8:
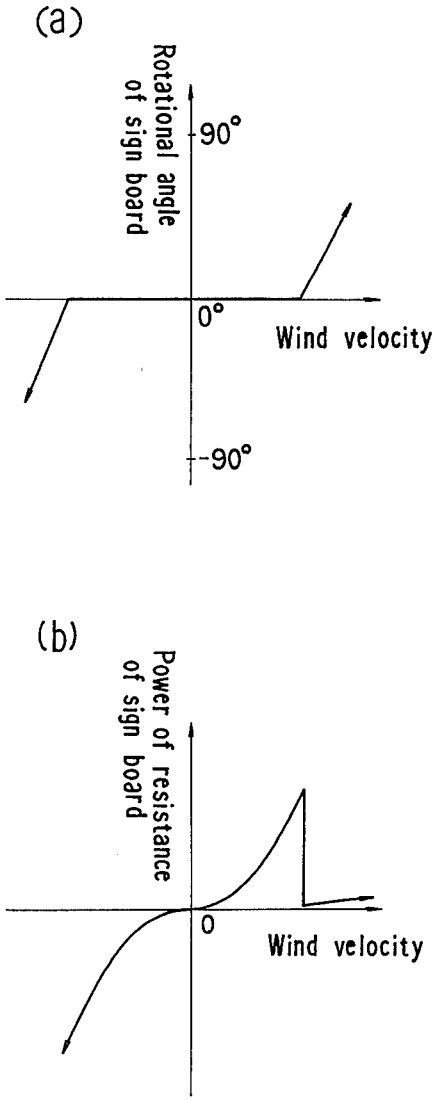
FIG. 8(*a*) is a graph showing the relation between the rotational angle of the sign board and wind pressure according to the conventional apparatus for hanging a board.

The same relation as shown in FIGS. 7*a* and 7*b* of the conventional apparatus (FIG. 2) is shown in FIGS. 8*a* and 8*b* for the comparison with that of the invention.

Figure 6:
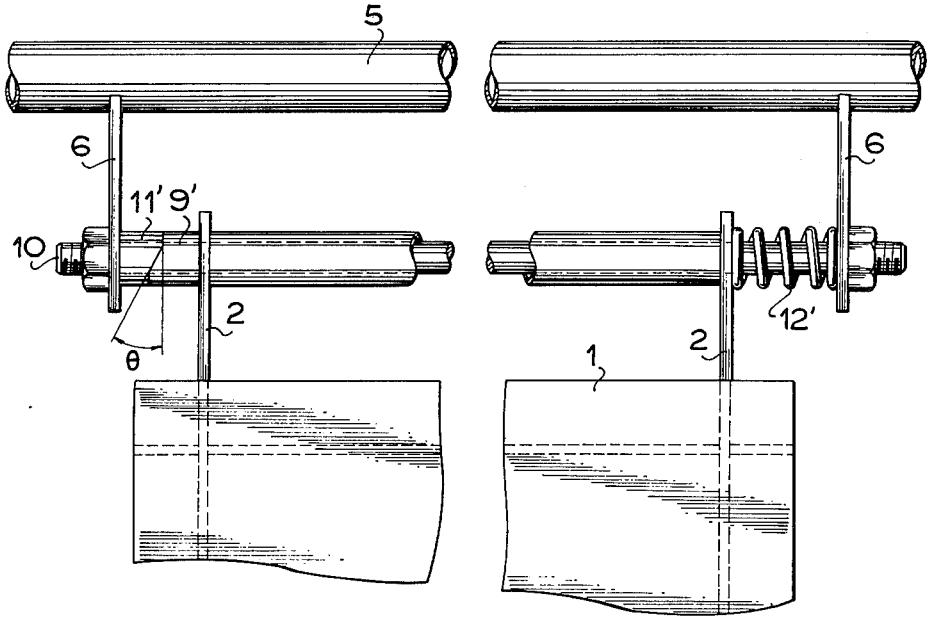
FIG. 6 is an enlarged elevational view of the main part of another embodiment of the invention.

The second embodiment of the invention is shown in FIG. 6. In this embodiment, a first cam sleeve 9' is provided not only rotatably but also slidably surrounding an axis 10 and is pressed by a spring 12 which is arranged on the opposite side of a second cam sleeve 11'. In this case, the second cam sleeve 11' does not slide axially and not rotate around the axis 10, and therefore the sign board moves in itself to the direction of the axis 10 when rotates around the axis 10, (i.e. when the slant face 9*d* slide along the slant face 11*d*).

In the above-described embodiments, the sign board is hung on the horizontal part of the pole 5, but another structure of support may be used instead of the pole 5 and an advertising sign board out-doors may by hung instead of the sign board 1.

As many apparently widely different embodiment of this invention may be made without departing from the spirit and scope thereof, it is to be understood that the invention is not limited to the specific embodiments thereof except as defined in the appended claims.

What is claimed is:

1. An apparatus for suspending a sign board from a support, comprising a shaft for suspending the sign board from the support, a first cam sleeve rotatably surrounding a portion of the shaft and supporting the sign board, a second non-rotatable cam sleeve surrounding another portion of the shaft, and a spring for biasing said first and second cam sleeves axially into engagement with each other, one of said first and second cam sleeves being axially movable; each of said first and second cam sleeves having cam surfaces with a lower face, a higher face and a slant face connecting the lower and higher faces, said spring biasing the cam surfaces towards each other so that when wind pressure on the sign board is weaker than a first predetermined strength, the condition is maintained in which both slant faces of said first and second cam sleeves, and the higher face of the one and the lower face of the other correspond to and contact with each other, when wind pressure is greater than the first and less than a second predetermined strength, the first cam sleeve rotates and the rotating force of the sign board is absorbed by the compression of said spring caused by the relative sliding movement in an axial direction of one of the first and second cam sleeves and when wind pressure is greater than the second predetermined strength the first cam sleeve further rotates so that both higher faces of the first and the second sleeves contact each other so as to have the sign board rotate only against the force of sliding friction between the higher faces, the pressure of wind being exerted on the sign board being reduced by said rotation.

2. An apparatus as claimed in claim 1 wherein said first cam sleeve is axially movable.

3. An apparatus as claimed in claim 1 wherein said second cam sleeve is axially movable.

* * * * *